US007550110B2

(12) United States Patent
Warner et al.

(10) Patent No.: US 7,550,110 B2
(45) Date of Patent: Jun. 23, 2009

(54) AL-ZN-MG-CU ALLOYS AND PRODUCTS WITH IMPROVED RATIO OF STATIC MECHANICAL CHARACTERISTICS TO DAMAGE TOLERANCE

(75) Inventors: Timothy Warner, Voreppe (FR); Christophe Sigli, Grenoble (FR); Bernard Bes, Seyssins (FR)

(73) Assignee: Alcan Rhenalu, Paris (FR)

( * ) Notice: Subject to any disclaimer, the term of this patent is extended or adjusted under 35 U.S.C. 154(b) by 318 days.

(21) Appl. No.: 10/406,609

(22) Filed: Apr. 4, 2003

(65) Prior Publication Data

US 2003/0219353 A1 Nov. 27, 2003

(30) Foreign Application Priority Data

Apr. 5, 2002 (FR) ..... 02 04257

(51) Int. Cl.
*C22C 21/10* (2006.01)

(52) U.S. Cl. ..... 420/532; 148/417

(58) Field of Classification Search ..... 148/417; 420/532, 552, 553
See application file for complete search history.

(56) References Cited

U.S. PATENT DOCUMENTS 4,345,951 A * 8/1982 Coupry et al. ..... 148/550
4,713,216 A * 12/1987 Higashi et al. ..... 420/532
5,221,377 A * 6/1993 Hunt et al. ..... 148/417
5,560,789 A * 10/1996 Sainfort et al. ..... 148/549
6,557,289 B2 * 5/2003 Stall et al. ..... 42/71.02
6,627,012 B1 * 9/2003 Tack et al. ..... 148/690
2002/0121319 A1 * 9/2002 Chakrabarti et al. ..... 148/694
2002/0162609 A1 * 11/2002 Warner ..... 148/439
2004/0089378 A1 * 5/2004 Senkov et al. ..... 148/417
2004/0099352 A1 * 5/2004 Gheorghe et al. ..... 148/550

FOREIGN PATENT DOCUMENTS

EP 81441 A1 * 6/1983
JP 08295977 A * 11/1996

OTHER PUBLICATIONS

"Aluminum and Aluminum Alloys", ASM International, 1993, pp. 41, 45.*

* cited by examiner

*Primary Examiner*—Roy King
*Assistant Examiner*—Janelle Morillo
(74) *Attorney, Agent, or Firm*—Baker Donelson Bearman Caldwell & Berkowitz PC

(57) ABSTRACT

The invention relates to alloys and associated products which are laminated, extruded or forged in Al—Zn—Mg—Cu alloy. Alloys of the invention generally comprise (in mass percentage):

a) Zn 8.3-14.0=Cu 0.3-4.0=Mg 0.5-4.5 Zr 0.03-0.15 Fe+Si<0.25 b) at least one element selected from the group consisting of Sc, Hf, La, Ti, Ce, Nd, Eu, Gd, Tb, Dy, Ho, Er, Y and Yb, the content of each elements; if included, being between 0.02 and 0.7%, and c) the aluminum remainder and inevitable impurities, and wherein Mg/Cu<2.4 and (7.7–0.4 Zn)>(Cu+Mg)>(6.4–0.4 Zn). Products of the present invention are useful as structural elements (for example wing unit caisson, wing unit extrados) in aeronautical construction.

35 Claims, 3 Drawing Sheets

AL-ZN-MG-CU ALLOYS AND PRODUCTS WITH IMPROVED RATIO OF STATIC MECHANICAL CHARACTERISTICS TO DAMAGE TOLERANCE

CLAIM FOR PRIORITY

The present invention claims priority under 35 U.S.C. § 119 from French Patent Application No. 02 04257 filed Apr. 5, 2002, the content of which is incorporated herein by reference in its entirety.

BACKGROUND OF THE INVENTION

1. Field of the Invention

This invention relates to Al—Zn—Mg—Cu alloys with improved static mechanical characteristics—damage tolerance ratio, and having a Zn content preferably greater than 8.3%, as well as structural elements for aeronautical construction incorporating refined and/or partially finished products manufactured from these alloys.

2. Description of Related Art

Al—Zn—Mg—Cu alloys (belonging to the family of 7xxx alloys) are currently in use in aeronautical construction, and particularly in the construction of civilian aircraft wings. For the exterior of the wings, a skin (wingskin) of plate made in 7150, 7055, 7449 alloys is often used, and optionally stiffeners (also called stringers) made from profiles in 7150, 7055, or 7449 alloys. These designations of alloys, as is well known in the art, correspond to those of The Aluminum Association.

Some of these alloys have been known for decades, such as for example 7075 and 7175 (zinc content between 5.1 and 6.1% by weight), 7050 (zinc content between 5.7 and 6.7%), 7150 (zinc content between 5.9 and 6.9%) and 7049 (zinc content between 7.2 and 8.2%). Such alloys have a high tensile yield strength, as well as good fracture toughness and good resistance to stress corrosion and to exfoliation corrosion. More recently, it has appeared that for certain applications, alloys with a higher zinc content can have certain advantages, such as having an increased tensile yield strength. 7349 and 7449 alloys have a zinc content between 7.5 and 8.7%. Wrought alloys higher in zinc have been described in the literature, are not typically used in aeronautical construction.

U.S. Pat. No. 5,560,789 (Pechiney) discloses an alloy composed of Zn 10.7%, Mg 2.84%, and Cu 0.92% which is transformed by extrusion. These alloys are not designed specifically to have an optimized static mechanical characteristic to toughness ratio.

U.S. Pat. No. 5,221,377 (Aluminum Company of America) discloses several Al—Zn—Mg—Cu alloys with a zinc content of up to 11.4%. These alloys are deficient in certain respects in terms of properties, as will be explained hereinbelow.

Moreover, it has been proposed to utilize high zinc containing Al—Zn—Mg—Cu alloys to manufacture hollow bodies intended to resist increased pressures, such as for example, compressed gas cylinders. European Patent Application EP 020 282 A1 (Société Métallurgique de Gerzat) discloses alloys with a zinc content of between 7.6% and 9.5%. European Patent Application EP 081 441 A1 (Société Métallurgique de Gerzat) discloses a process for obtaining such cylinders. European Patent Application EP 257 1 67 A1 (Société Métallurgique de Gerzat) states that no known Al—Zn—Mg—Cu alloys can safely and reproducibly satisfy the strict technical demands imposed by this specific application for gas cylinders. EP 257 1 67 A1 proposes moving towards a lower zinc content, namely between 6.25% and 8.0%. The teaching of these patents is specific to problems relating to compressed gas cylinders, particularly concerning maximizing the bursting pressure of these cylinders, and thus cannot be transferred to other wrought products.

Generally in Al—Zn—Mg—Cu alloys, not only is a high zinc content desirable, but Mg and Cu are also generally included in order to obtain good static mechanical characteristics (ultimate tensile strength ($R_m$ or UTS) and tensile yield strength ($R_{p0.2}$ or TYS).). This is only possible if these elements (Zn, Mg, Cu) can be put into solid solution. It is also well known (see, for example U.S. Pat. No. 5,221,377) that when the zinc content is increased in a 7xxx alloy beyond around 7 to 8%, then problems associated with insufficient resistance to exfoliation corrosion and stress corrosion will arise. More generally, it is known that the most charged Al—Zn—Mg—Cu alloys are likely to pose corrosion problems. These problems are generally resolved by employing specific thermal or thermomechanical treatments, especially by pushing the aging treatment beyond the peak, for example during a type T7 temper or treatment. But such treatments can then cause a corresponding drop in the static mechanical characteristics. In other words, in order to obtain a given minimum level of resistance to corrosion for an Al—Zn—Mg—Cu alloy, one must find a compromise between static mechanical characteristics (TYS $R_{p0.2}$, UTS $R_m$, and elongation at fracture A) and damage tolerance characteristics (fracture toughness, crack propagation rate etc.). According to the desired minimal level of resistance to corrosion sought to be obtained, either (i) a temper close to peak strength is utilized (T6 tempers), which generally offers an acceptable toughness to TYS ratio favouring static mechanical characteristics, or (ii) annealing is pushed beyond the peak strength (T7 tempers), by seeking a compromise favouring fracture toughness. These metallurgic states are defined in standard EN 515.

SUMMARY OF THE INVENTION

The present invention is therefore directed toward a novel alloy and associated novel wrought Al—Zn—Mg—Cu type products with a high zinc content (i.e. greater than 8.3%), as well as their associated methods. Products of the present invention generally posses an improved compromise between fracture toughness and static mechanical characteristics (UTS, TYS). Products of the invention further typically present adequate resistance to corrosion and increased elongation at fracture, and are also generally capable of being manufactured industrially under conditions of highest reliability compatible with the severe requirements of the aeronautical industry.

The present inventors have found that these and other objectives can be addressed, inter alia, by finely adjusting the concentration of Zn, Cu and/or Mg in the alloy as well as controlling the content of certain impurities (particularly Fe and Si), and further by optionally adding other elements.

In yet further accordance with these and other objects, one embodiment of the present invention is directed to an Al—Zn—Mg—Cu alloy that can be rolled, extruded and/or forged, comprising (in mass percentage):

a) Zn 8.3-14.0 Cu 0.3-4.0 (preferably 0.3-3.0) Mg 0.5-4.5 (preferably 0.5-3.0) Fe+Si<0.25, Zr 0.03-0.15 b) at least one element selected from the group consisting of Sc, Hf, La, Ti, Ce, Nd, Eu, Gd, Tb, Dy, Ho, Er, Y and Yb, the content of each elements, if included, being between 0.02 and 0.7%, c) remainder aluminum and inevitable impurities, and wherein Mg/Cu<2.4 and (7.7−0.4 Zn)>(Cu+Mg)>(6.4−0.4 Zn).

In still yet further accordance with the present invention, there is provided another embodiment directed to an Al—Zn—Mg—Cu alloy that can be rolled, extruded and/or forged, comprising (in mass percentage):

a) Zn 9.5-14.0 Cu 0.3-4.0 (preferably 0.3-3.0) Mg 0.5-4.5 (preferably 0.5-3.0) Fe+Si<0.25 b) at least one element selected from the group consisting of Zr, Sc, Hf, La, Ti, Ce, Nd, Eu, Gd, Tb, Dy, Ho, Er, Y, Yb, Cr and Mn, the content of each element, if included, being between 0.02 and 0.7%, c) remainder aluminum and inevitable impurities, and wherein Mg/Cu<2.4 and (7.7−0.4 Zn)>(Cu+Mg)>(6.4−0.4 Zn).

In yet still further accordance with the present invention, there is provided another embodiment directed to a structural member for aeronautical construction incorporating at least one product, particularly to a structural member suitable for the construction of wing unit caissons on civilian aircraft, such as a wing exteriors.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

| | |
|---|---|
| 1, 4 | Extrados |
| 2 | Intrados |
| 3 | Spar |
| 5 | Stiffener |
| 6 | Caisson height |
| 7 | Caisson width |

Figure 2:
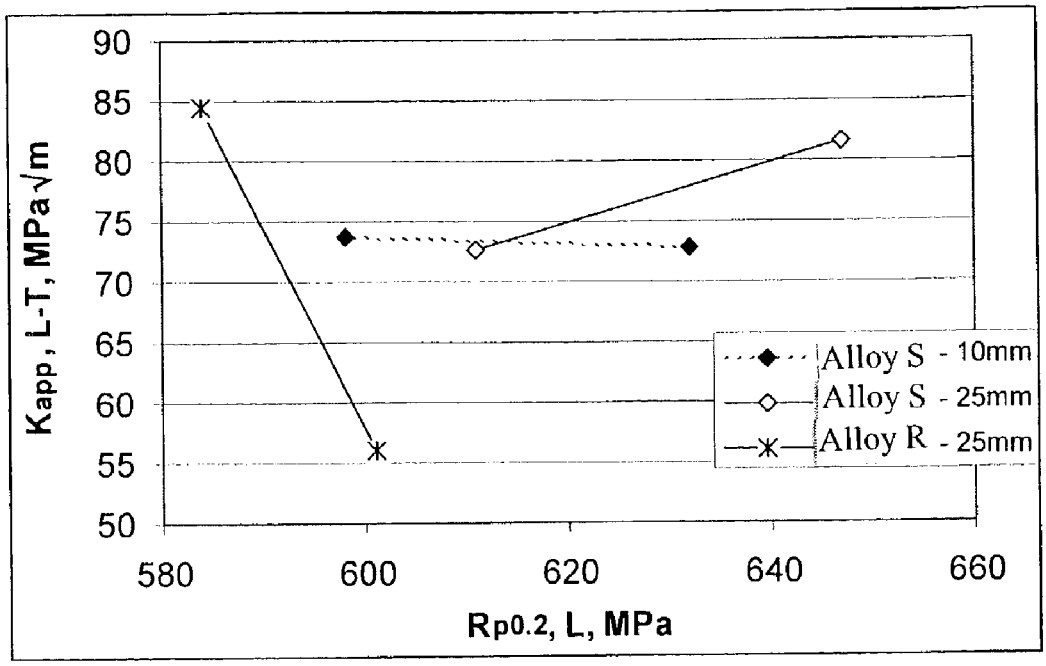
Figure 3:
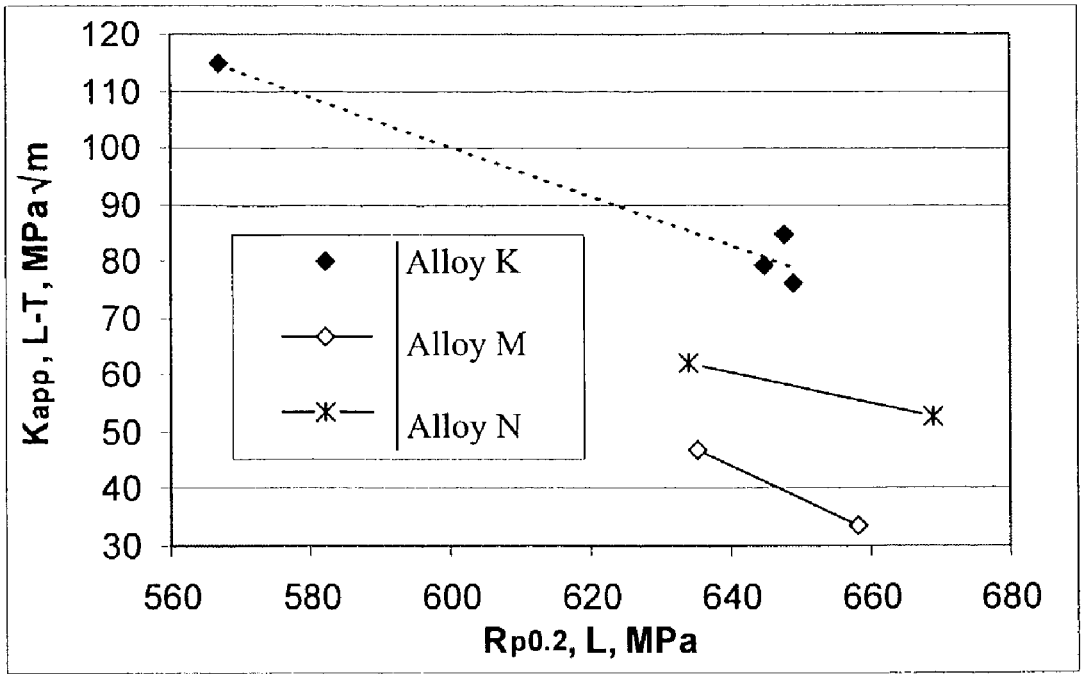

FIGS. 2 and 3 represent the compromise between mechanical resistance and damage tolerance.

DETAILED DESCRIPTION OF A PREFERRED EMBODIMENT

Unless indicated otherwise, the chemical compositions are given as percentages by weight (% by weight) based on total weight of the article being described. Therefore, in a mathematical formula, "0.4 Zn" means "0.4 times the zinc content, expressed in percentage by weight." This also applies to other chemical elements as well as Zn. The alloy designations used herein follow the rules of The Aluminum Association. The metallurgical tempers are as defined in the European Standard EN 515 which is incorporated herein by reference in its entirety. Unless indicated otherwise, the static mechanical characteristics, i.e. ultimate tensile strength $R_m$, tensile yield strength $R_{p0.2}$, elongation at fracture A, are determined by a tensile test according to the standard EN 10002-1 which is incorporated herein by reference in its entirety. The term "extruded product" includes all extruded materials including so-called "drawn" products obtained by extrusion, followed by drawing.

In connection with the present invention, the present inventors unexpectedly arrived at a conclusion that a novel material exhibiting a significantly improved compromise between mechanical strength and formability should preferably possess a sufficiently high zinc content, typically above 8.3%, and advantageously above 9.0%. According to the present invention, the inventors have found a very specific domain of composition that permits formation of wrought products, which at the same time possess, high static mechanical properties, sufficient resistance to corrosion, and good fracture toughness. According to one embodiment of the present invention, this task can be solved, inter alia, by carefully controlling the content of the elements of the alloys and certain impurities, as well as by optionally adding a controlled concentration of certain other elements to the alloy composition.

The present invention includes Al—Zn—Mg—Cu alloys comprising:

Zn 8.3-14.0 Cu 0.3-4.0 Mg 0.5-4.5 as well as certain other elements specified hereinbelow, the balance being aluminum with its inevitable impurities.

Alloys according to some embodiments of the present invention should preferably include at least 0.5% magnesium, since it may be not possible to obtain satisfactory static mechanical characteristics with a magnesium content lower than about 0.5%. A zinc content below 8.3% does not lead to an improvement with respect to prior art. Preferably, the zinc content is above 9.0%, and still more preferably above 9.5%. In a preferred embodiment, the zinc content is between 9.0% and 11.0%. It is advantageous, however, not to exceed a zinc content of approximately 14%, because beyond this value, irrespective of the magnesium and copper content, the results may be unsatisfactory. It is advantageous that certain numerical relations between the concentration of certain elements be respected, as will be explained below. The preferable addition of at least 0.3% of copper serves to improve resistance to corrosion. To help ensure satisfactory solution heat treatment, the Cu content should preferably not exceed about 4%, and the Mg content should preferably not exceed about 4.5%. A maximum content of about 3.0% is preferred for each Cu and Mg in some embodiments.

The present inventors have found that to address certain problems in the art regarding Al—Zn—Mg—Cu alloys, several additional technical features can be considered if necessary: First of all, the alloy should typically be sufficiently loaded with alloying elements likely to precipitate during maturation or annealing treatment, in order for the alloy to be capable of presenting advantageous static mechanical characteristics. As such, in addition to the preferred minimum and maximum concentrations for the zinc, magnesium and copper indicated hereinabove, the content of these alloy additions should advantageously satisfy the condition Mg+Cu>6.4−0.4 Zn in some embodiments. This was a finding that was completely unexpected based on the teachings of the prior art. Furthermore, the applicant has noted that to obtain a sufficient level of toughness, it is preferred that Mg/Cu<2.4, preferably <2.0 and more preferably still <1.7.

To reinforce the effect achieved using the disclosed preferred alloy composition(s), disclosed above, a sufficient content of so-called anti-recrystallising elements can also advantageously be added. More precisely, for alloys with more than about 9.5% zinc, at least one element selected from the group consisting of Zr, Sc, Hf, La, Ti, Y, Ce, Nd, Eu, Gd, Tb, Dy, Ho, Er, Yb, Cr and Mn can preferably be added. And each of these elements, if added, should preferably be present in a concentration of between 0.02 and 0.7%. It is preferred that the total concentration of the elements of this group not exceed about 1.5%, based on the total weight of the alloy.

The presence of one or more anti-recrystallising elements, in the form of fine precipitates formed during thermal or thermomechanical treatment, serve to block or at least minimize recrystallisation. However, it has unexpectedly been found that when the alloy is highly charged with zinc (Zn>9.5%) excessive precipitation should be avoided when a wrought product is being quenched, because the presence of anti-recrystallising elements has been found to influence precipitation during quenching. A compromise then was found for the anti-recrystallising elements content by the present inventors. Namely, according to one embodiment of the invention, for alloys with a zinc content of between 8.3% and 9.5%, zirconium between 0.03% and 0.15% should advantageously be added, preferably along with at least one element selected from the group consisting of Sc, Hf, La, Ti, Y, Ce, Nd, Eu, Gd, Tb, Dy, Ho, Er and Yb. Each element present in this group, is preferably present in a concentration of between 0.02 and 0.7%. In a preferred embodiment, Ti is present, alone or together with one or more other elements from the above group.

The present inventors have also noted that for the anti-recrystallising elements it is advantageous, irrespective of the zinc content, not to exceed the following maximum contents: Cr 0.40; Mn 0.60; Sc 0.50; Zr 0.15; Hf 0.60; Ti 0.15; Ce 0.35 and preferably 0.30; Nd 0.35 and preferably 0.30; Eu 0.35 and preferably 0.30; Gd 0.35; Tb 0.35; Ho 0.40; Dy 0.40; Er 0.40; Yb 0.40; Y 0.20; La 0.35 and preferably 0.30. It is preferred that the total concentration of the elements of this group not exceed about 1.5%, based on the total weight of the alloy.

Another technical feature is associated with the need to be able to manufacture wrought products industrially under conditions of very high or even the highest reliability that are still compatible with the severe requirements of the aeronautical industry, as well as under satisfactory economic conditions. So it is highly advantageous to choose a chemical composition that minimises the appearance of hot cracks or splits during solidification of the plates or billets. Hot cracks or splits are crippling defaults leading to plates or billets that are discarded. It has been noted during numerous tests that the appearance of hot cracks or splits was unexpectedly much more probable when the 7xxx alloys finished solidifying below 470° C. To significantly reduce the probability of hot cracks or splits during casting to an acceptable industrial level, it was determined according to the present invention that it may be advantageous to employ in some instances a chemical composition such as one meeting the below relationship:

$$Mg>1.95+0.5(Cu—2.3)+0.16(Zn—6)+1.9(Si—0.04)$$

Within the scope of the present invention, the above empirical criterion $Mg>1.95+0.5(Cu—2.3)+0.16(Zn—6)+1.9(Si—0.04)$ is called the "castability criterion." Alloys produced according to this variant of the invention typically complete their solidification at a temperature of between about 473° C. and 478° C., and thus allow an industrial reliability of metal working processes (that is, a constant and excellent quality of the cast ingots) to be reached that is generally compatible with some, if not all, of the severe requirements of the aeronautical industry.

Another technical feature of one embodiment of the invention is substantially minimizing the quantity of insoluble precipitates following homogenisation and aging treatments to the extent possible. This is because the presence of such insoluble precipitates decreases the fracture toughness. Thus, it may be advantageous to employ, a Mg, Cu and Zn content such as $Mg+Cu<7.7-0.4\ Zn$. Such precipitates are typically Al—Zn—Mg—Cu ternary or quaternary phases of type S, M or T.

The inventors have also noted that optionally incorporating a small quantity, of between 0.02 and 0.15% per element, of one or more elements selected from the group consisting of Sn, Cd, Ag, Ge and In, may serve to improve the response of the alloy to an annealing treatment, and also provides beneficial effects in terms of mechanical resistance and resistance to corrosion of products made from such alloys. If employed, each of these elements can be included in a preferred individual concentration between 0.05% and 0.10%. Among these elements, silver is advantageous in some embodiments.

The present invention is especially advantageous for use in rolled or extruded products. They can be used advantageously to produce structural members in aeronautical construction. A preferred application of the products according to the present invention is as a member in a wing unit caisson, and in particular in its upper section (extrados or exterior) which is primarily dimensioned to resist compression.

Figure 1:
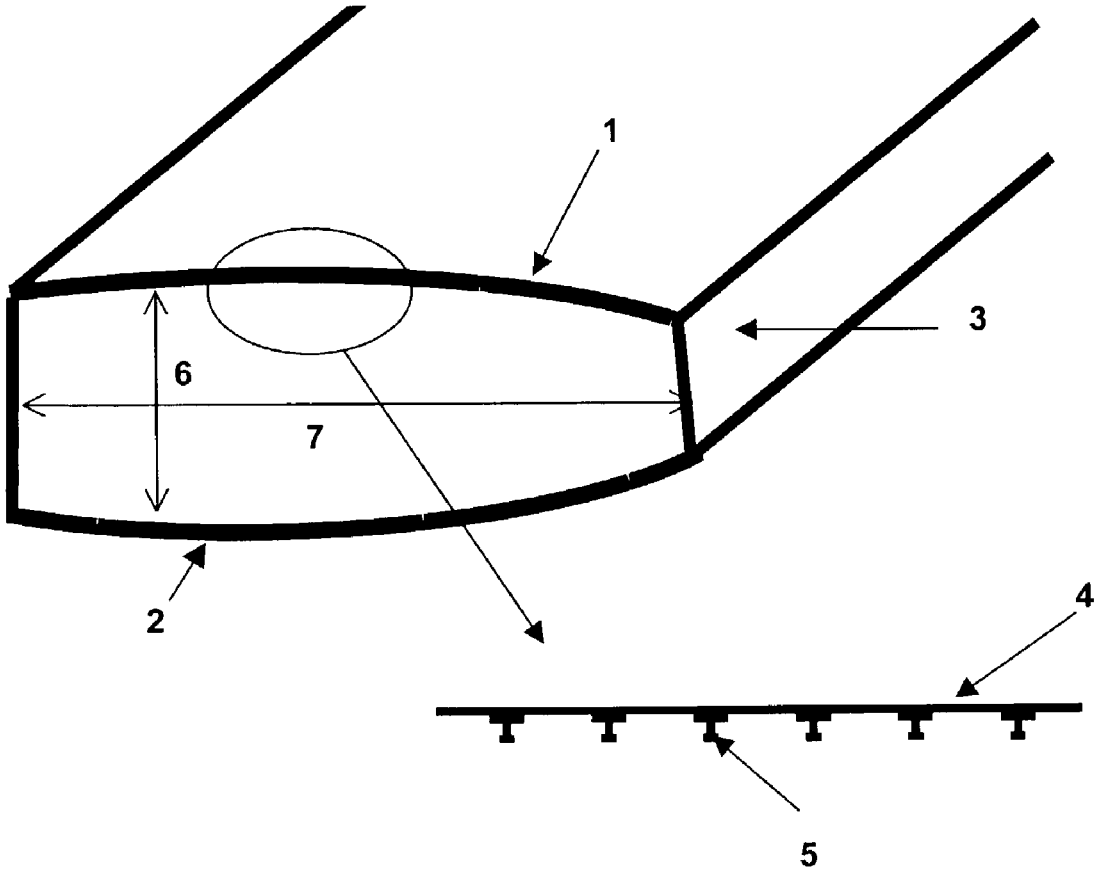
FIG. 1 diagrammatically illustrates a wing unit caisson of an aircraft. The reference numerals are as follows.

FIG. 1 diagrammatically illustrates a section of the wing unit caisson of a civilian aircraft. Such a wing unit caisson typically has a length of between 10 m and 40 m and a width of between 2 m and 10 m; its height varies in terms of the site on the wing and is typically between 0.2 m and 2 m. The caisson is made up of the extrados (1) and intrados (2). The extrados (1) of a civilian aircraft constitutes a plate of typical thickness at delivery of between 15 mm and 60 mm, and by stiffeners (5) that can be produced by machining profiles and then fixed to the skin using mechanical fastening means or fasteners (such as rivets, bolts) or by welding techniques (such as arc welding, laser welding, and/or friction welding). The extrados—stiffener structure can also be attained by assembling other semi-finished products in aluminum alloy and/or by integral machining of plates or profiles strong or profiles, i.e. without assembly.

In general, so as to reduce the weight of such a structure as much as possible, it is preferable to reduce the number of fastening means (rivets, bolts etc) and/or welded joints. As a consequence, it is desirable to use plates or extruded products whose dimensions are also as close as possible to those of the finished wing unit caisson. This need to use very large semi-finished products, (for example, of a width of between 0.5 m and 4 m, a thickness of between 10 mm and 60 mm or even 100 mm, and a length of between 6 m and more than 20 m), limits the choice of usable materials. More particularly, in the case of rolled products, it may be necessary to be capable of obtaining these very large plates with a certain adequate industrial reliability. For very large-scale aircraft the length of the aircraft wings can exceed 20 m and even 30 m, favouring the use of plates or profiles of a length greater than 20 m or 30 m, so as to minimise assembly of the members.

Manufacturing plates or profiles of such a size in highly charged Al—Zn—Mg—Cu alloys requires excellent and highly detailed control of casting procedures, rolling processes and/or thermal and thermomechanical processes, and also may sometimes require adaptation of the chemical composition according to the invention. In profiles of relatively small thickness or width, a considerable augmentation of the static mechanical characteristics was observed. This is known as a "press effect" to one skilled in the art. A press effect was not observed for thick profiles.

Products according to the present invention can be used as structural members in aeronautical construction. For applications such as extrados, a metallurgic state or temper of type T6 is preferred, for example T651. State or temper T7 can also be conceivably used, as well as any temper or treatment that would permit the desired properties and profiles requisite.

Rolled, extruded or forged semi-finished products can be manufactured, which present a very interesting compromise of properties, particularly for aeronautical construction. For example, there is provided a tensile yield strength $R_{p0.2}$ (L) preferably greater than 630 MPa, and more preferably, even greater than 640 MPa, a toughness $K_{1C}$ (L-T) preferably greater than 23 MPa$\sqrt{m}$ and more preferably, even greater than 25 MPa$\sqrt{m}$, elongation at fracture A preferably, greater than 8%, and more preferably even greater than 10%, while keeping resistance to exfoliation corrosion and stress corrosion to a level at least comparable to that of known Al—Zn—Mg—Cu alloys. Products according to the present invention can exhibit an value of $Ka_{pp(L-T)}$, determined according to ASTM E561 at T/2 on a specimen with a width W=406 mm, of at least 70 MPa$\sqrt{m}$, and preferably of at least 75 MPa$\sqrt{m}$.

Products according to the invention are particularly well adapted to being used as structural elements in wing unit caissons, for example in the form of an extrados or a stiffener. Advantages of alloys and products according to the present invention, in particular, allow them to be used as structural members in very large-sized aircraft, particularly civilian aircraft, and particularly preferably in the form of rolled and/or extruded products. In a particularly advantageous application, these structural members are manufactured from plates having a thickness greater than about 60 mm.

In the case of profiles, the addition of one or more anti-recrystallising elements, such as scandium, is particularly advantageous. Such an advantageous effect of one or more anti-recrystallising elements is also observed in the case of strong sheets. When the added anti-recrystallising element is scandium, a content of between 0.02 and 0.50% is advantageous. The addition of a small quantity of silver or another element such as Cd, Ge, In and/or Sn (of the order of 0.05 to 0.10%) improves the annealing efficacy, and has positive effects on the mechanical resistance and resistance to stress corrosion of the product.

The following examples illustrate different embodiments of the invention and demonstrate its advantages; they do not restrict this invention.

EXAMPLES

Example 1

Several Al—Zn—Mg—Cu alloys were prepared by semi-continuous casting of rolling ingots, and were then subjected to a range of conventional transformation techniques, comprising a homogenisation stage, followed by hot rolling, a solution heat treatment followed by quenching and stress relieving operations. Finally an aging treatment was conducted in order to obtain a product in temper T651 having a thickness of 20 mm.

The compositions of the plates are specified in Table 1.

TABLE 1

| Alloy | Zn | Mg | Cu | Fe | Si | Zr | Ti | Mn | Sc | Mg/Cu |
|---|---|---|---|---|---|---|---|---|---|---|
| A | 8.40 | 2.11 | 1.83 | 0.09 | 0.06 | 0.11 | 0.017 | 0 | 0 | 1.15 |
| B | 10.27 | 3.2 | 0.71 | 0.08 | 0.03 | 0.11 | 0.017 | 0 | 0 | 4.57 |
| C | 10.08 | 2.69 | 0.95 | 0.08 | 0.03 | 0.11 | 0.014 | 0 | 0 | 2.83 |
| D | 9.97 | 2.14 | 1.32 | 0.09 | 0.03 | 0.11 | 0.017 | 0 | 0 | 1.62 |

Alloy A is 7449 alloy according to the prior art, alloys B and C are alloys having a high Zn content, although not meeting certain technical characteristics of the invention in terms of Mg/Cu, and alloy D is an alloy according to the invention.

The tensile static mechanical characteristics were determined by a tensile test according to standard EN 10002-1, incorporated herein by reference in its entirety. Compressive yield strength $R_{p0,2}{}^{C}$, which is a dimensioning property for extrados, was determined according to ASTM E9, and the fracture toughness $K_{1C}$ was determined according to standard ASTM E399, both of which are incorporated herein by reference.

The results are specified in Table 2:

TABLE 2

| | Tensile properties in L direction | | | Tensile properties in LT direction | | | Compression properties in L direction | Fracture toughness in L-T direction |
|---|---|---|---|---|---|---|---|---|
| Alloy | $R_{p0,2}$ MPa | $R_m$ MPa | A % | $R_{p0,2}$ MPa | $R_m$ MPa | A % | $R_{p0,2}{}^{C}$ MPa | $K_{1C}$ MPa$\sqrt{m}$ |
| A | 627 | 665 | 14.7 | 566 | 623 | 13.6 | 618 | 31.9 |
| B | 716 | 726.5 | 6.5 | 640 | 696 | 5.2 | 703 | 21.1 |
| C | 700 | 717 | 9.2 | 629 | 676 | 8.1 | 675 | 21 |
| D | 665 | 685 | 12.2 | 608 | 649 | 11 | 656 | 26.8 |

An alloy according to the present invention presents a superior compromise or ratio of static characteristics/toughness as compared with 7449 according to the prior art ($R_{p0.2}$ higher and $K_{1C}$ similar). Further, alloys with a high zinc content but not meeting the technical characteristics of the invention in terms of Mg and Cu are less effective.

Example 2

Two alloys having chemical compositions specified in Table 3 were cast and then transformed utilising a process similar to that of Example 1, apart from the fact that the sheets obtained were 6 mm thick.

TABLE 3

| Alloy | Zn | Mg | Cu | Fe | Si | Zr | Ti | Mn | Sc |
|---|---|---|---|---|---|---|---|---|---|
| E | 8.42 | 2.09 | 1.9 | 0.07 | 0.02 | 0.1 | 0.016 | 0 | 0 |
| F | 8.34 | 2.11 | 1.84 | 0.07 | 0.03 | 0.11 | 0.018 | 0 | 0.083 |

Alloy E is an 7449 as per the prior art, and alloy F is an alloy according to the present invention, containing an addition of 0.083% of scandium.

The static mechanical characteristics obtained are presented in Table 4 below. The toughness was characterised using a Kahn indicator, well known in the art and described in particular in the article by J. G. Kaufman and A. H. Knoll, "Kahn-Type Tear Tests and Crack Toughness of Aluminum Sheet", published in Materials Research & Standards, pp. 151-155, (1964). The $K_{app}$ parameter was measured according to the standard ASTM E561-98 (incorporated herein by reference) on samples of type CT of width W equal to 127 mm. The $K_{app}$ parameter ("K apparent") is the factor of stress intensity calculated using the maximum charge measured during the test and the initial crack length (after pre-cracking) in the formulae specified by the cited standard. These indicators are used conventionally to measure the toughness under plane stress. The results of the toughness measurements performed during this test are presented in Table 5 below.

TABLE 4

| Alloy | Tensile test in L direction $R_{p0.2}$ MPa | $R_m$ MPa | A % | Tensile test in L-T direction $R_{p0.2}$ MPa | $R_m$ MPa | A % |
|---|---|---|---|---|---|---|
| E | 615 | 649 | 13.7 | 588 | 646 | 13.3 |
| F | 648 | 688 | 13.9 | 605 | 652 | 15.1 |

TABLE 5

| Alloy | Kahn indicator (L-T) MPa | Kahn indicator (T-L) MPa | $K_{app}$ (L-T) MPa$\sqrt{m}$ | $K_{app}$ (T-L) MPa$\sqrt{m}$ |
|---|---|---|---|---|
| E | 231 | 212 | 58 | 37 |
| F | 236 | 218 | 57 | 36 |

The results of Tables 4 and 5 clearly show improvement in the static mechanical characteristics of the inventive alloy that has a toughness similar, or even better, than that of 7449 owithout scandium.

Example 3

2 alloys were cast whose compositions are specified in Table 6. They were transformed using a process similar to the one described in example 1, with the exception that the thickness of the obtained plates was 25 mm and 10 mm, respectively, and that two different aged tempers were elaborated: temper T651 (aging at 120° C. for 48 h) defined as the peak mechanical tensile strength, and temper T7×51 (24 h 120° C.+17 h 150° C.).

TABLE 6

| Alloy | Zn | Mg | Cu | Fe | Si | Zr | Ti | Mn | Sc |
|---|---|---|---|---|---|---|---|---|---|
| R | 8.3 | 2.13 | 1.85 | 0.030 | 0.032 | 0.11 | 0.017 | 0 | 0 |
| S | 8.6 | 2.1 | 1.9 | 0.07 | 0.03 | 0.11 | 0.017 | 0 | 0.078 |

Alloy R is an 7449 alloy, and alloy S is an alloy according to the present invention, containing an addition of 0.078% of scandium.

The static mechanical properties obtained for tempers T651 and T7951 at half thickness are summarized in Table 7 below.

Plane deformation fracture toughness $K_{1C}$ was determined at half thickness according to ASTM E399. Plane stress fracture toughness was determined at half thickness by means of the parameter $K_{app}$, measured according to ASTM E561 on CCT-type specimen of width W=406 mm. The results of these fracture toughness measurements are summarized in table 8 below.

TABLE 7

| Alloy Thickness | Temper | Tensile test in L direction $R_{p0,2}$ MPa | $R_m$ MPa | A % | Tensile test in LT direction $R_{p0,2}$ MPa | $R_m$ MPa | A % |
|---|---|---|---|---|---|---|---|
| S - 10 mm | T651 | 632 | 655 | 7.9 | 612 | 649 | 9.6 |
| | T7x51 | 598 | 619 | 8.6 | 601 | 622 | 7.5 |
| S - 25 mm | T651 | 647 | 681 | 12.8 | 606 | 649 | 13.2 |
| | T7x51 | 611 | 644 | 12.4 | 588 | 622 | 11.9 |

TABLE 7-continued

| Alloy Thickness | Temper | Tensile test in L direction $R_{p0,2}$ MPa | $R_m$ MPa | A % | Tensile test in LT direction $R_{p0,2}$ MPa | $R_m$ MPa | A % |
|---|---|---|---|---|---|---|---|
| R - 25 mm | T651 | 601 | 637 | 10.4 | 584 | 620 | 10.2 |
| | T7x51 | 584 | 622 | 10.9 | 565 | 597 | 10.8 |

TABLE 8

| Alloy Thickness | Temper | $K_{1C}$ (L-T) MPa$\sqrt{m}$ | $K_{1C}$ (T-L) MPa$\sqrt{m}$ | $K_{app}$ (L-T) MPa$\sqrt{m}$ |
|---|---|---|---|---|
| S - 10 mm | T651 | Not determined | | 72.8 |
| | T7x51 | | | 73.7 |
| S - 25 mm | T651 | 24 | 24 | 81.6 |
| | T7x51 | 25 | 22 | 72.6 |
| R - 25 mm | T651 | 231 | 212 | 56.1 |
| | T7x51 | 236 | 218 | 84.4 |

FIG. 2 shows the compromise between mechanical strength and fracture toughness in a diagram $R_{p0,2}$-$K_{app}$ for the alloys of example 3. It can be seen that the reference alloy R exhibits the usual compromise (fracture toughness increasing with decreasing mechanical strength). Surprisingly, the alloy according to the present invention (alloy S) exhibits only a very small decrease (thickness 10 mm), and even an increase in fracture toughness (thickness 25 mm), with increasing mechanical strength. Furthermore, the alloy according to the present invention shows a mechanical strength significantly higher than the reference alloy 7449, and a fracture toughness which is comparable or even higher.

Example 4

Several alloys were cast whose compositions are specified in Table 9, each having an Si content approximately equal to 0.04%.

Alloys G1, G2, G3 and G4 are outside certain embodiments of the present invention, as well as alloys B and C, described in example 1. Alloy D is an alloy according to the present invention described in example 1. During testing all these alloys exhibited satisfactory castability, that is, no splits or cracks were observed during casting tests performed on an industrial scale.

Alloys G5, G6, G7, G8 are outside certain embodiments of the present invention, and alloy G9 is an alloy 7060 as per the prior art; these alloys exhibited cracks during casting tests. The difficulties showing up during casting of these alloys did not necessarily render the wrought products from these plates unsuitable for use, but they are the cause of extra costs because the costs associated with their implementation (that is, the quantity of vendible metal relative to the quantity of charged metal, a parameter directly associated with the quantity of discarded plates) will be greater than for the alloys corresponding to certain preferred embodiments of the present invention. In addition, the propensity of these alloys to form splits during their solidification makes reliability of the casting process very difficult within the scope of a quality assurance program by statistical mastery of the processes.

It is noted that all the 7xxx alloys having a very pronounced propensity to form splits or cracks in casting have a magnesium content lower than certain desired magnesium contents;

desirable Mg contents can be obtained by calculating the Mg limit value defined by the "castability criterion."

TABLE 9

| Alloy | Zn (weight %) | Mg (weight %) | Cu (weight %) | Observed crack-ability | Critical Mg content | Mg > Critical Mg |
|---|---|---|---|---|---|---|
| G1 | 7.5 | 3 | 3 | low | 2.54 | yes |
| G2 | 8.5 | 3 | 2.3 | low | 2.35 | yes |
| G3 | 7.5 | 3 | 1.6 | low | 1.84 | yes |
| G4 | 6.5 | 3 | 2.3 | low | 2.03 | yes |
| B | 10.27 | 3.2 | 0.71 | low | 1.82 | yes |
| C | 10.08 | 2.69 | 0.95 | low | 1.91 | yes |
| D | 9.97 | 2.14 | 1.32 | low | 2.08 | yes |
| G5 | 8.5 | 2.3 | 3 | high | 2.7 | no |
| G6 | 6.5 | 2.3 | 3 | high | 2.38 | no |
| G7 | 8.5 | 1.6 | 2.3 | high | 2.35 | no |
| G8 | 7.5 | 1.6 | 1.6 | high | 1.84 | no |
| G9 | 7 | 1.65 | 2.1 | high | 2.01 | no |

Example 5

Rolling ingots were elaborated using a process similar to the one described in example 1. The chemical composition is given in table 10. Plates with a thickness of 25 mm were elaborated by using a process similar to the one described in example 1. The plates were solution heat treated at a temperature between 472 and 480° C. for 2 hours. This temperature range was determined by means of preliminary calorimetric measurements on plates in the as-rolled temper, which is a procedure known to one skilled in the art. After solution heat-treatment, quenching was performed by spraying water onto the plates. Stress-relieving was then carried out by stretching with a permanent set of 1.5 to 2%, followed by aging at 135° C.

TABLE 10

| Alloy | Zn | Mg | Cu | Fe | Si | Zr | Ti | Mn | Sc | Mg/Cu |
|---|---|---|---|---|---|---|---|---|---|---|
| M | 9.94 | 3.02 | 0.78 | 0.04 | 0.03 | 0.10 | 0.063 | 0 | 0 | 3.87 |
| N | 10.00 | 2.72 | 0.77 | 0.06 | 0.04 | 0.10 | 0.055 | 0 | 0.10 | 3.53 |
| K | 9.90 | 2.03 | 1.55 | 0.03 | 0.03 | 0.10 | 0.05 | 0 | 0.10 | 1.31 |

Static mechanical properties were determined by a tensile test as well as by a compression test. Fracture toughness $K_{app}$ was measured as explained in the preceding examples.

TABLE 11

| Alloy | Duration of aging H | $R_{p0,2}$ MPa | $R_m$ MPa | A % | $R_{p0,2}{}^C$ MPa | $K_{app}$ (L-T) MPa$\sqrt{m}$ |
|---|---|---|---|---|---|---|
| | | Tensile test in L direction | | | Compression test in L direction | |
| N | 14.5 | 692 | 699 | 9.7 | 669 | 52.7 |
| N | 35 | 657 | 672 | 11.2 | 634 | 61.9 |
| M | 14.5 | 676 | 690 | 10.0 | 658 | 33.4 |
| M | 35 | 648 | 658 | 9.9 | 635 | 47.0 |
| K | 12.5 | Not determined | | | 645 | 79.4 |
| K | 14.5 | 671 | 689 | 11.7 | 649 | 76.2 |
| K | 35 | 659 | 672 | 11.4 | 648 | 84.8 |
| K | 120 | Not determined | | | 567 | 115.0 |

It was checked that for plates N, M and K, the aging treatment of 14.5 h leads to the T651 temper. For aging times significantly longer, $R_{p0,2}$, $R_{p0,2}{}^C$ and $R_m$ decrease while $K_{app}$ increases. The compromise between mechanical strength and damage tolerance is shown in a $R_{p0.2}$-$K_{app}$ diagram (FIG. 3) for the alloys of example 5.

It can be seen that for the same Zn content and the same scandium content, plate K (having a lower Mg/Cu ratio) exhibits a fracture toughness significantly higher than plate N.

Example 6

Extrusion billets of diameter 291 mm were cast by vertical casting of an alloys whose composition in given in table 12.

TABLE 12

| Alloy | Zn | Mg | Cu | Cr | Mn | Si | Fe | Zr | Ti | Mg/Cu |
|---|---|---|---|---|---|---|---|---|---|---|
| T | 9.43 | 1.96 | 1.67 | — | 0.01 | 0.05 | 0.07 | 0.12 | 0.03 | 1.17 |

The homogenized (7 h at 460° C.+23 h at 466° C.) and scalped billets were extruded; the temperature of the die and of the container was above 400° C., and the extrusion speed was below 0.50 m/min. The profile cross section included a foot (thickness 15 mm, width 152 mm), an intermediate section (thickness 15 mm, heigth 38 mm) and a top (thickness 23 mm, width 76 mm).

After solution heat treatment (4 h at 472° C. plus the heating-up period) quenching and controlled stretching, the profiles were aged to a T7A511 temper (6 h 120° C.+7 h 135° C.) or to a T7B511 temper (6 h 120° C.+28 h 135° C.); the letters A and B here indicate these different aging conditions.

For comparison, profiles of similar geometry in alloy 7449, the exact composition of which was outside of the scope of the present invention, were prepared in temper T79511.

The results of the various characterizations of these profiles are given in table 13.

TABLE 13

| Alloy (Position) | Temper | Static properties in L direction: Tensile test $R_{p0,2}$ MPa | $R_m$ MPa | A % | Compression $R_{p0,2}{}^C$ MPa | Fracture toughness $K_{1C}$ (L-T) MPa$\sqrt{m}$ | $K_{1C}$ (T-L) MPa$\sqrt{m}$ |
|---|---|---|---|---|---|---|---|
| 7449 (top) | T79511 | 625 | 650 | 13.0 | 645 | 30 | 20 |
| T (top) | T7A511 | 694 | 707 | 11.5 | 712 | 46.8 | 20.4 |
| T (foot) | | 669 | 689 | 12.3 | 665 | 34.2 | 22.1 |
| T (intermediate section) | | 664 | 678 | 11.6 | 659 | n.d. | n.d. |
| T (top) | T7B511 | 681 | 685 | 10.6 | 707 | 37.0 | 20.3 |
| T (foot) | | 663 | 670 | 11.0 | 676 | 29.0 | 22.8 |
| T (intermediate section) | | 661 | 666 | 10.2 | 666 | n.d. | n.d. |

It is clear from these results that alloy T according to the invention exhibits an improved compromise between mechanical strength and fracture.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

The priority document, French Patent Application No. 02 04257, filed Apr. 5, 2002 is incorporated herein by reference in its entirety.

As used herein and in the following claims, articles such as "the", "a" and "an" can connote the singular or plural.

All documents referred to herein are specifically incorporated herein by reference in their entireties.

The invention claimed is:

1. An Al—Zn—Mg—Cu alloy product with a thickness of up to 60 mm, said alloy consisting of (in mass percentage):

a) Zn 9.0-9.5 Cu 1.32-1.67 Mg 1.6-about 1.96 Zr 0.03-0.15 Fe+Si<0.25, b) Ti from 0.02-0.15%, and c) aluminum remainder and inevitable impurities, and wherein Mg/Cu<1.7 and (7.7−0.4 Zn)>(Cu+Mg)>(6.4−0.4 Zn), wherein the elastic limit of said product is $R_{p0.2}$(L)>661 MPa and wherein the product comprises a breaking elongation A%(L) >10%.

2. A laminated, extruded or forged product comprising an alloy product as claimed in claim 1.

3. A civilian aircraft comprising an alloy product as claimed in claim 1.

4. A semi-finished product having a width between 0.5 m and 4m, a thickness from 10 mm to 60 mm and a length of between 6 m and more than 20 m comprising an alloy product as claimed in claim 1.

5. An alloy product as claimed in claim 1, wherein $K_{app}$ measured in the Long-Transverse direction according to ASTM E561 at half thickness on a specimen with the width W=406 mm is equal or greater than 70 MPa√m.

6. An alloy product as claimed in claim 1, wherein $K_{app}$ measured in the Long-Transverse direction according to ASTM E561 at half thickness on a specimen with the width W=406 mm is equal or greater than 75 MPa√m.

7. An alloy product as claimed in claim 1, with the proviso that Mg is not less than or equal to Cu.

8. An alloy product as claimed in claim 1, with the proviso that Mg is not less than or equal to Cu+0.1.

9. An alloy product as claimed in claim 1, with the proviso that Mg is not less than or equal to Cu+0.2.

10. An alloy product as claimed in claim 1, with the proviso that Mg is not less than or equal to Cu+0.3.

11. A structural element suitable for aeronautical construction, incorporating at least one Al—Zn—Mg—Cu alloy product having a thickness of up to 60 mm which is laminated and/or extruded, said alloy consisting of (in mass percentage):

a) Zn 9.0-9.5 Cu 1.32-1.67 Mg 1.6-about 1.96 Zr 0.03-0.15 Fe+Si<0.25, b) Ti from 0.02-0.15%, and c) aluminum remainder and inevitable impurities, and wherein Mg/Cu<1.7, (7.7−0.4 Zn)>(Cu+Mg)>(6.4−0.4 Zn), and wherein the elastic limit of said product is $Rpo_2$(L)>661 MPa and wherein the product comprises a breaking elongation A%(L)>10%.

12. A laminated, extruded or forged product comprising a structural element as claimed in claim 11.

13. A structural element as claimed in claim 11, wherein $K_{1C}$(L-T)>23 Mpa√m.

14. A civilian aircraft comprising a structural element as claimed in claim 11.

15. A semi-finished product having a width between 0.5 m and 4m, a thickness from 10 mm to 60 mm and a length of between 6 m and more than 20 m comprising a structural element as claimed in claim 11.

16. A structural element as claimed in claim 11, wherein $K_{app}$ measured in the Long-Transverse direction according to ASTM E561 at half thickness on a specimen with the width W=406 mm is equal or greater than 70 MPa√m.

17. A structural element as claimed in claim 11, wherein $K_{app}$ measured in the Long-Transverse direction according to ASTM E561 at half thickness on a specimen with the width W=406 mm is equal or greater than 75 MPa√m.

18. A structural element as claimed in claim 11, wherein Mg>Cu.

19. A structural element as claimed in claim 11, with the proviso that Mg is not less than or equal to Cu.

20. A structural element as claimed in claim 11, with the proviso that Mg is not less than or equal to Cu+0.1.

21. A structural element as claimed in claim 11, with the proviso that Mg is not less than or equal to Cu+0.2.

22. A structural element as claimed in claim 11, with the proviso that Mg is not less than or equal to Cu+0.3.

23. An alloy product as claimed in claim 1, wherein $K_{1C}$ (L-T)>23 Mpa√m.

24. An alloy product as claimed in claim 23, wherein $K_{1C}$ (L-T)>25 Mpa√m.

25. An alloy product as claimed in claim 24, wherein $K_{1C}$ (L-T) is at least 29 Mpa√m.

26. A wing unit caisson having an extrados manufactured from an Al—Zn—Mg—Cu alloy sheet having a thickness of up to 60 mm, wherein said sheet consists of an alloy of (in mass percentage):

a) Zn 9.0-9.5 Cu 1.32-1.67 Mg 1.6-about 1.96 Zr 0.03-0.15 Fe+Si<0.25, b) Ti from 0.02-0.15%, and c) aluminum remainder and inevitable impurities, and wherein said sheet satisfies the following conditions Mg/Cu<1.7; and (7.7−0.4 Zn)>(Cu+Mg)>(6.4−0.4 Zn), wherein the elastic limit of said extrados is RpO.2(L)>661 MPa and wherein the extrados comprises a breaking elongation A%(L)>10%.

27. A wing unit caisson as claimed in claim 26, wherein said sheet is used in metallurgic state T6 or T651.

28. A wing unit caisson as claimed in claim 26, wherein said sheet is used in metallurgic state T7.

29. A wing unit caisson comprising at least one stiffener of a product having a thickness of up to 60 mm extruded in Al—Zn—Mg—Cu alloy, wherein said extruded product consists of (in mass percentage):

a ) Zn 9.0-9.5 Cu 1.32-1.67 Mg 1.6-about 1.96 Zr 0.03-0.15 Fe+Si<0.25 b) Ti from 0.02-0.15%, and c) aluminum remainder and inevitable impurities, and wherein said stiffener satisfies the conditions Mg/Cu<1.7

(7.7−0.4 Zn)>(Cu+Mg)>(6.4−0.4 Zn), wherein the elastic limit of said extruded product is Rp0.2(L)>661 MPa and wherein the extruded product comprises a breaking elongation A%(L)>10%.

30. A wing unit caisson as claimed in claim 29, wherein said extruded product is used in metallurgic state T6 or T651.

31. A wing unit caisson as claimed in claim 29, wherein said extruded product is used in metallurgic state T7.

32. An Al—Zn—Mg—Cu extruded alloy product having a thickness of up to 60 mm, consisting of (in mass percentage):

a) Zn 9.0-9.5 Cu 1.32-1.67 Mg 1.6-about 1.96 Zr 0.03-0.15Fe+Si<0.25, b) Ti from 0.02-0.15%, and c) aluminum remainder and inevitable impurities, and wherein Mg/Cu<1.7, (7.7−0.4 Zn)>(Cu+Mg)>(6.4−0.4 Zn)

and with the proviso that Mg is not less than or equal to Cu+0.1, the elastic limit of said product is $Rp_{0.2}(L)$ >661 MPa and the extruded product comprises a breaking elongation A%(L)>10%, said extruded product comprises a foot, an intermediate section and a top section, and $K_{1C}$(L-T) for the top section is at least 37 MPa√m.

33. An Al—Zn—Mg—Cu extruded alloy product having a thickness of up to 60 mm, consisting of (in mass percentage):

a) Zn 9.0-9.5 Cu 1.32-1.67 Mg 1.6-about 1.96 Zr 0.03-0.15 Fe+Si<0.25, b) Ti from 0.02-0.15%, and c) aluminum remainder and inevitable impurities, and wherein Mg/Cu<1.7, (7.7−0.4 Zn)>(Cu+Mg)>(6.4−0.4 Zn), the magnesium and copper content thereof is selected such that Mg is not less than or equal to Cu and Mg+Cu is not less than or equal to 3.3, the elastic limit of said product $Rp_{0.2}(L)$ >661 MPa the extruded product comprises a breaking elongation A%(L)>10%, said extruded product comprises a foot, an intermediate section and a top section, and $K_{1C}$(L-T) for the top section is at least 37 MPa√m.

34. An Al—Zn—Mg—Cu extruded alloy product having a thickness of up to 60 mm, consisting of (in mass percentage):

a) Zn 9.0-9.5 Cu 1.32-1.67 Mg 1.6-about 1.96 Zr 0.03-0.15 Fe+Si<0.25, b) Ti from 0.02-0.15%, and c) aluminum remainder and inevitable impurities, and wherein Mg/Cu<1.7, (7.7-0.4 Zn)>(Cu+Mg)>(6.4-0.4 Zn), the magnesium and copper content thereof is selected such that Mg is not less than or equal to Cu+0.3, and Mg+Cu is not less than 3.5, the elastic limit of said product is $Rp_{0.2}(L)$>661 MPa, the extruded product comprises a breaking elongation A%(L)>10%, said extruded product comprises a foot, an intermediate section and a top section, and $K_{1C}$(L-T) for the top section is at least 37 MPa√m.

35. An Al—Zn—Mg—Cu extruded alloy product with a thickness of up to 60 mm, said alloy consisting of (in mass percentage):

a) Zn: about 9.43 Cu: about 1.32-1.67 Mg: 1.6-about 1.96 Zr 0.03-0.15 Fe+Si<0.25, b) Ti from 0.02-0.15%, and c) aluminum remainder and inevitable impurities, wherein the elastic limit of said product is $R_{p02}(L)$>661 MPa, the product comprises a breaking elongation A%(L) >10%, said extruded product comprise a foot, an intermediate section and a top section, and $K_{1C}$(L-T) for the top section is at least 37 MPa√m.

* * * * *